US009850611B2

(12) United States Patent
Lee et al.

(10) Patent No.: US 9,850,611 B2
(45) Date of Patent: Dec. 26, 2017

(54) WASHING MACHINE HAVING DRYING APPARATUS

(71) Applicant: Samsung Electronics Co., Ltd., Suwon-si (KR)

(72) Inventors: Jung Hee Lee, Suwon-si (KR); Wan Gi Park, Suwon-si (KR); Hyun Mook Kim, Osan-si (KR); Amitoj Singh, Gurgaon (IN); Karma Bhutia, Noida (IN); Kab Jin Jun, Gwangju-si (KR); Ji Hoon Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 624 days.

(21) Appl. No.: 14/444,280

(22) Filed: Jul. 28, 2014

(65) Prior Publication Data

US 2015/0033574 A1 Feb. 5, 2015

(30) Foreign Application Priority Data

Aug. 1, 2013 (KR) ..... 10-2013-0091535

(51) Int. Cl.

| | |
|---|---|
| ***D06F 58/18*** | (2006.01) |
| ***D06F 29/00*** | (2006.01) |
| ***D06F 57/12*** | (2006.01) |

(52) U.S. Cl.

CPC ..... *D06F 29/005* (2013.01); *D06F 57/12* (2013.01); *D06F 58/18* (2013.01)

(58) Field of Classification Search

CPC ..... D06F 58/18; D06F 29/005; D06F 57/12

See application file for complete search history.

(56) References Cited

U.S. PATENT DOCUMENTS

| | | | | | |
|---|---|---|---|---|---|
| 1,767,157 | A * | 6/1930 | Steele | D06F 58/10 | 312/245 |
| 2,658,777 | A * | 11/1953 | Rauglas | F16B 7/1409 | 248/188.5 |
| 3,626,602 | A * | 12/1971 | Glowacki | D06F 58/14 | 34/232 |
| 4,094,414 | A * | 6/1978 | Thiot | A47G 25/0685 | 211/1.3 |
| 2009/0172965 | A1* | 7/2009 | Campagnolo | D06F 58/20 | 34/72 |

FOREIGN PATENT DOCUMENTS

| | | |
|---|---|---|
| JP | 7-303795 | 11/1995 |
| KR | 20-1995-009061 | 4/1995 |

* cited by examiner

*Primary Examiner* — Jessica Yuen

(74) *Attorney, Agent, or Firm* — Staas & Halsey LLP

(57) ABSTRACT

A washing machine having a drying apparatus, which can perform a heated drying operation and shorten a drying time of laundry, is provided. The washing machine having a drying apparatus includes a top cover which is provided in an upper part of a body and has at least one air hole formed in a top surface thereof, a drying duct which is provided in the top cover to supply air heated by a heater provided thereinside to the air hole, and a rack member which is provided to be extractable from the body to hang laundry above the body.

11 Claims, 13 Drawing Sheets

WASHING MACHINE HAVING DRYING APPARATUS

CROSS-REFERENCE TO RELATED APPLICATIONS

This application claims the priority benefit of Korean Patent Application No. 10-2013-0091535, filed on Aug. 1, 2013 in the Korean Intellectual Property Office, the disclosure of which is incorporated herein by reference.

BACKGROUND

1. Field

Embodiments relate to a washing machine having a drying apparatus which can perform a heated air drying operation.

2. Description of the Related Art

In general, laundry can be dried using a washing line or a drying rack indoors or outdoors.

When drying the laundry outdoors, it can be influenced by weather. For example, when it rains, the outdoor laundry has to be collected one by one, and when the outdoor laundry is not collected in time such as when one is not at home, etc., the laundry gets soaked by the rain and has to be washed again.

When drying the laundry indoors, an additional drying space has to be secured utilizing a narrow interior space, and the washing line or the drying rack has to be installed indoors. Accordingly, this causes problems in aesthetic appearances.

Also, since the laundry is not dried well indoor due to humidity, there is a problem in that a drying time of the laundry becomes longer.

SUMMARY

In an aspect of one or more embodiments, there is provided a washing machine having a drying apparatus which can decrease a drying time of laundry by performing a heated air drying operation.

In an aspect of one or more embodiments, there is provided a washing machine having a drying apparatus which can improve drying efficiency since heated air is supplied in various directions.

In an aspect of one or more embodiments, there is provided a washing machine having a drying apparatus which can utilize a space by the drying apparatus with an extractable structure in an upward direction from the washing machine.

In an aspect of one or more embodiments, there is provided a washing machine having a drying apparatus which includes a top cover which is provided in an upper part of a body and has at least one air hole formed in a top surface thereof, a drying duct which is provided in the top cover to supply air heated by a heater provided thereinside to the air hole, and a rack member which is provided to be extractable from the body to hang laundry above the body.

The washing machine may further include a guide member provided in a bottom part of the air hole for guiding air flow upward.

The guide member may have curvature.

The drying duct may include a heater thereinside.

The drying duct may include air blast fans provided in both side end parts thereof.

The rack member may include a first rack member provided to be installed in the body and to be vertically movable, and a second rack member provided to be coupled to an upper end of the first rack member and hang the laundry.

The first rack member may include a fixing rack fixed to the body, a moving rack provided to be movable in and out of the fixing rack, and a locking apparatus for locking or unlocking movement of the moving rack between the fixing rack and the moving rack.

The locking apparatus may include a handle, a first moving member provided inside the moving rack and coupled to the handle, a wire coupled to the first moving rack, a second moving member coupled to the wire and provided to be vertically movable, an elastic member for elastically supporting the second moving member, a locking ball provided to lock or unlock the movement of the moving rack by interlocking with movement of the second moving member, and a supporting bracket provided such that the locking ball supports between the moving rack and the fixing rack.

One or more of the air holes may be formed in the first rack member.

The washing machine may further include a guide member for guiding air flow to the air hole inside the first rack member.

One or more of the air holes may be formed in a bottom surface of the second rack member.

In an aspect of one or more embodiments, there is provided a washing machine which includes a body, a top cover installed in a top surface of the body and including at least one air hole provided in the top surface thereof, and a drying apparatus provided in the top cover and to discharge heated air to the air hole, wherein the drying apparatus includes a drying duct provided in the top cover and including a heater thereinside, air blast fans installed in both side end parts of the drying duct, and provided to discharge the heated air to the air hole, and a rack member provided to be movable upward from the body and on which to hang laundry.

The rack member may include a first rack member installed in the body and provided to be vertically movable, and a second rack member coupled to an upper end of the first rack member and provided to hang the laundry.

The first rack member may include a fixing rack fixed to the body, a moving rack provided to be movable from an inner side to an outer side of the fixing rack, and a locking apparatus for locking or unlocking movement of the moving rack between the fixing rack and the moving rack.

The locking apparatus may include a handle, a first moving member provided inside the moving rack and coupled to the handle, a wire coupled to the first moving rack, a second moving member coupled to the wire and provided to be vertically movable, an elastic member for elastically supporting the second moving member, a locking ball provided to lock or unlock the movement of the moving rack by interlocking with movement of the second moving member, and a supporting bracket provided such that the locking ball supports between the moving rack and the fixing rack.

The washing machine may further include a guide member for guiding air flow upward in a bottom part of the air hole.

One or more of the air holes may be formed in the first rack member.

One or more of the air holes may be formed in a bottom surface of the second rack member.

In an aspect of one or more embodiments, there is provided a washing machine having a drying apparatus including a top cover which is provided in an upper part of a body and has a plurality of air holes formed in a top surface thereof; a drying duct which is provided in the top cover to supply heated air to the air holes; and a rack member configured to be extractable from the body to hang laundry above the body, wherein the rack member comprises a first rack member configured to be installed in the body and to be vertically movable in the body, and a second rack member configured to be coupled to an upper end of the first rack member and configured to hang the laundry, and wherein air holes are formed in the first rack member and a bottom surface of the second rack member.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
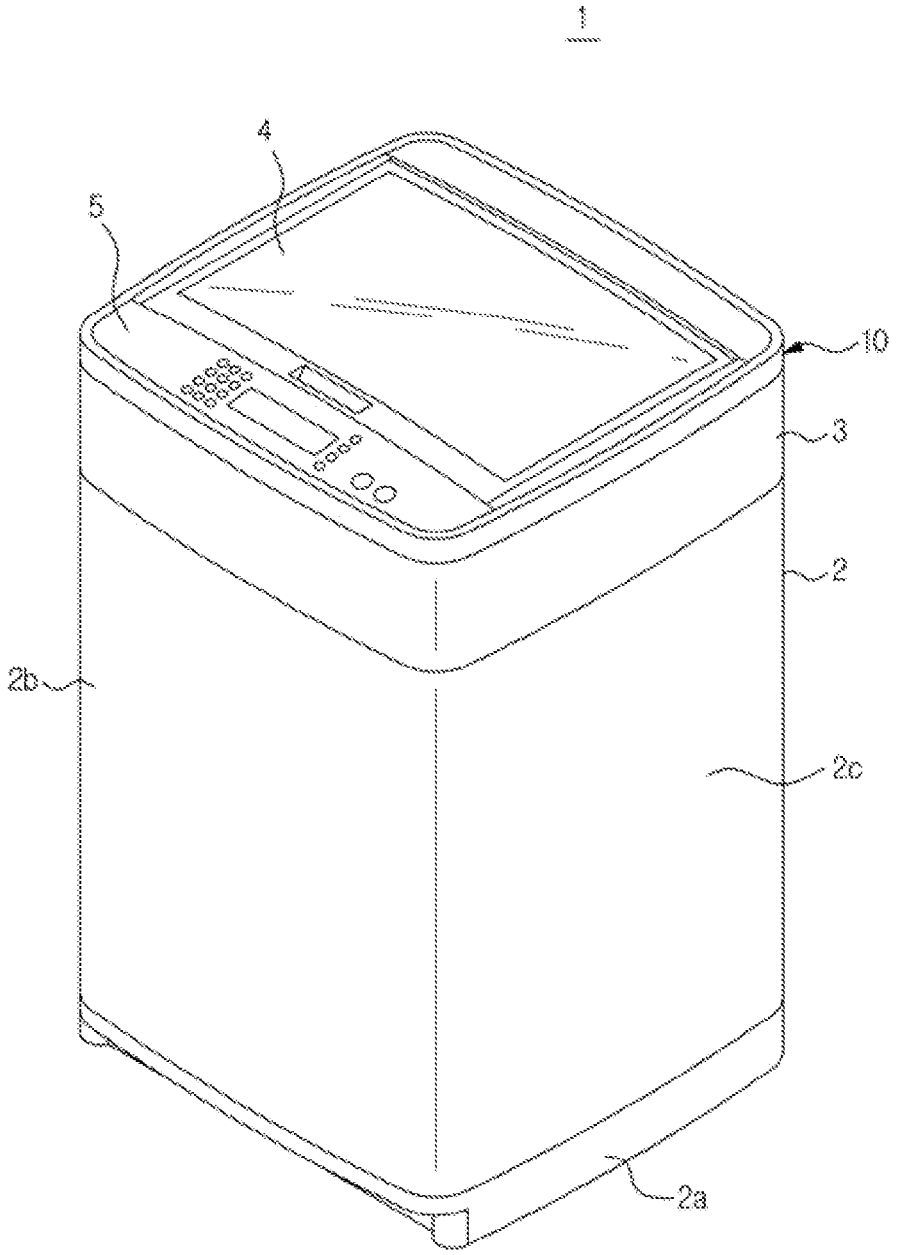
FIG. 1 is a perspective view of a washing machine according to an embodiment.

Reference will now be made in detail to embodiments, examples of which are illustrated in the accompanying drawings, wherein like reference numerals refer to like elements throughout.

Figure 2:
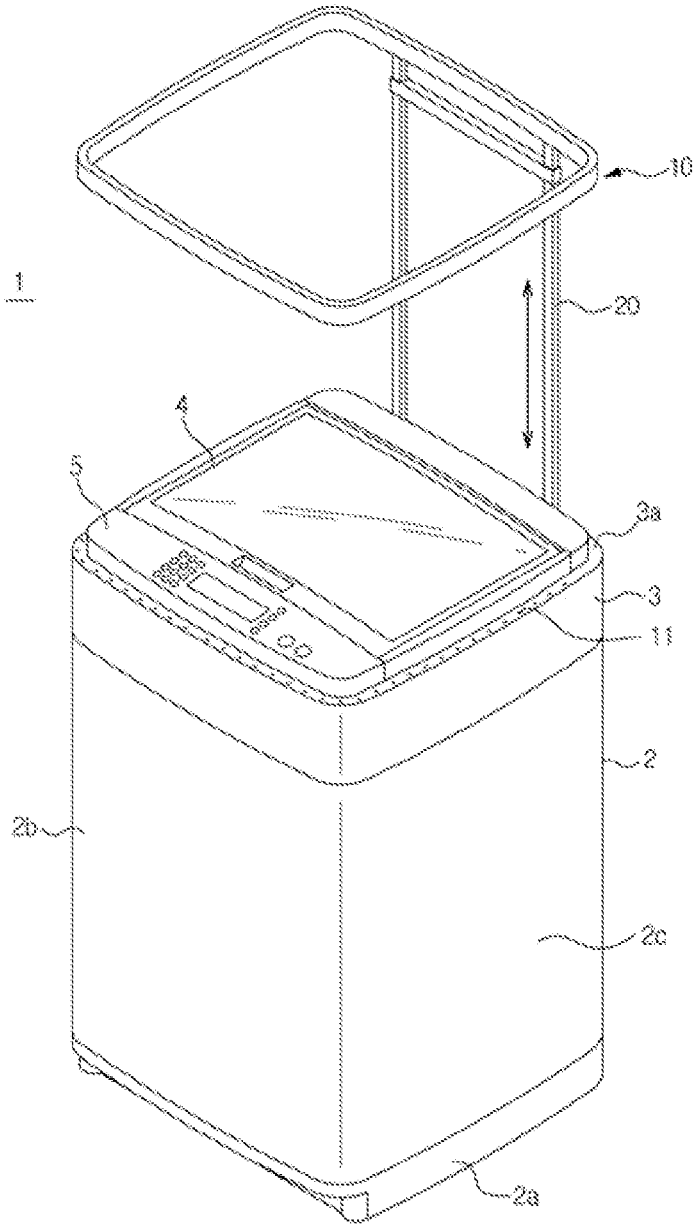
FIG. 2 is a perspective view of a washing machine having a drying apparatus according to an embodiment.

FIG. 1 is a perspective view of a washing machine according to an embodiment, and FIG. 2 is a perspective view of a washing machine having a drying apparatus according to an embodiment.

As shown in FIGS. 1 and 2, a washing machine 1 includes a body 2 which forms an exterior, a tub (not shown) which is installed in the body 2 and in which washing water is stored, a cylindrical drum (not shown) which is rotatably installed in the tub and in which laundry is put, and a pulsator (not shown) which rotates by being rotatably installed at a lower part inside the cylindrical drum and which washes the laundry by friction in the cylindrical drum by generating a stream of water.

The body 2 is formed by a bottom panel 2*a*, both side panels 2*c*, a rear side panel 2*d*, and a front panel 2*b*, and a top cover 3 is provided at an upper part of the body 2.

The top surface of the body 2 is opened so as to allow the laundry to be put in the cylindrical drum, and the top cover 3 of the body 2 is coupled to the opened top surface of the body 2.

A door 4 is vertically rotatably installed at the rear of the top surface of the top cover 3, and opens and closes the top surface of the top cover 3.

Although not shown, a driving apparatus (not shown) which rotates the cylindrical drum and the pulsator, and a drainage apparatus (not shown) which drains the water stored in the tub to the outside after the washing operation is completed are installed at a lower part inside the body 2, and a water supply apparatus (8, FIG. 6) which supplies the water to the tub is installed at the upper part of the body 2.

A control panel 5 may be installed at the front of the top surface of the top cover 3 so as to control a washing method and a washing process of the laundry according to types and quantities of the laundry.

Figure 3:
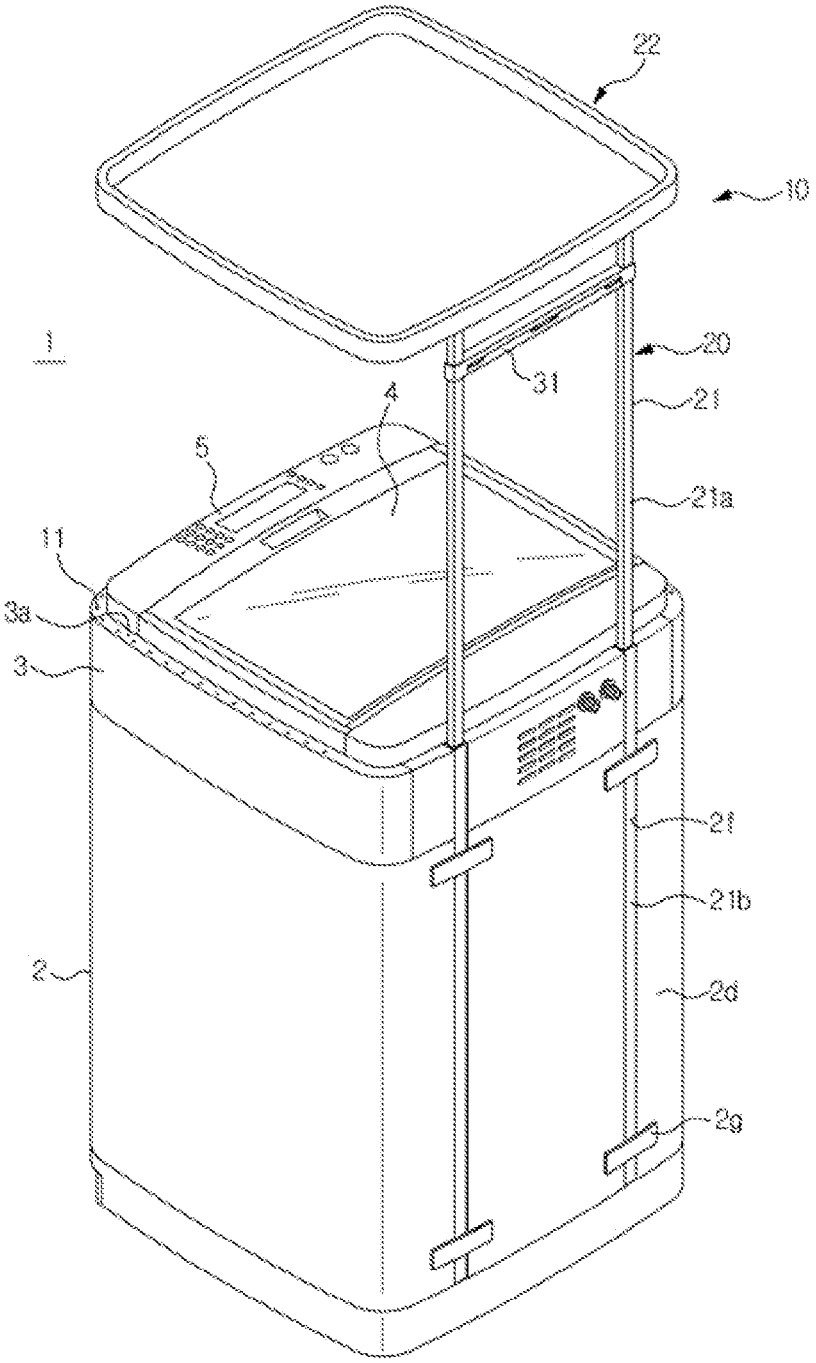
FIG. 3 is a perspective view of a rack member of a drying apparatus according to an embodiment.
Figure 4:
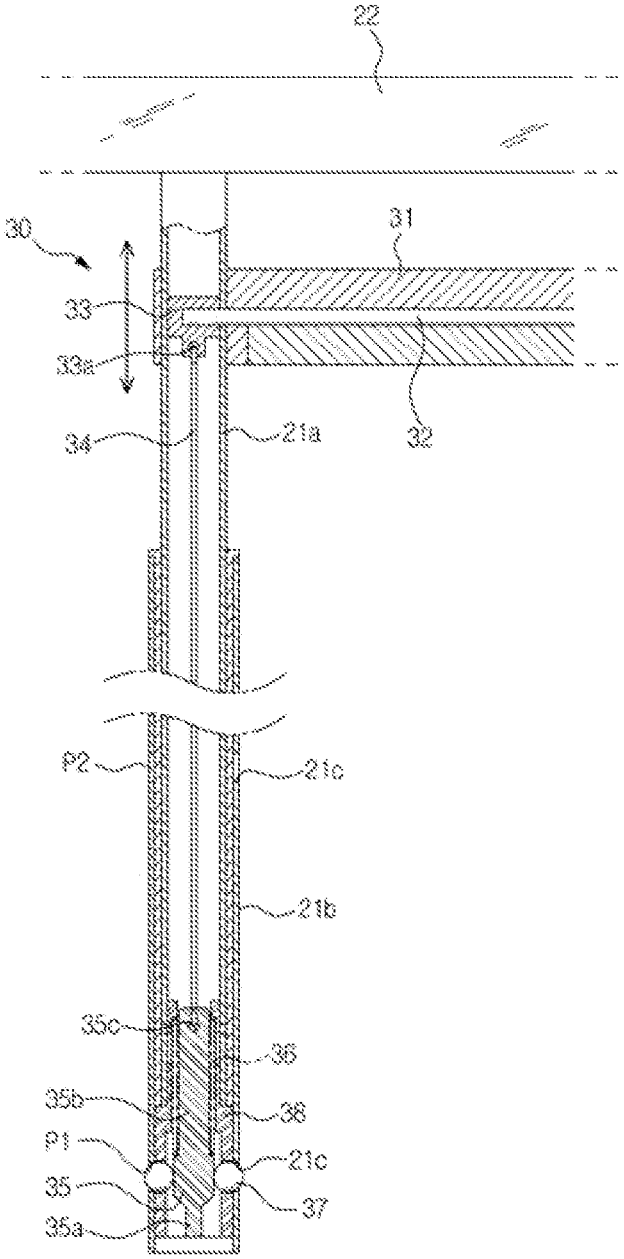
FIG. 4 is a schematic diagram of a locking apparatus of a rack member according to an embodiment.
Figure 5:
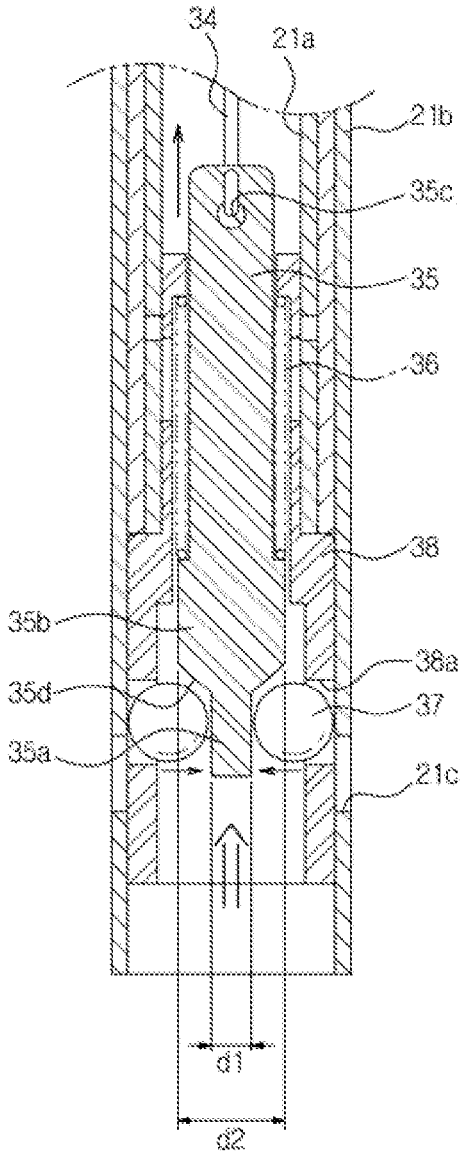
FIG. 5 is a schematic diagram for explaining an unlocking operation of a locking apparatus of a rack member according to an embodiment.

FIG. 3 is a perspective view of a rack member of a drying apparatus according to an embodiment, FIG. 4 is a schematic diagram of a locking apparatus of a rack member according to an embodiment, and FIG. 5 is a schematic diagram for explaining an unlocking operation of a locking apparatus of a rack member according to an embodiment.

As shown in FIGS. 3 to 5, a drying apparatus 10 according to an embodiment includes an air hole 11 which is formed in the top cover 3, a drying duct (40, FIG. 6) which is provided in the top cover 3, and a rack member 20 which is provided above the body 2 so as to hang the laundry that has undergone the washing operation.

It is desirable that a plurality of the air holes 11 be formed in the edge of a top surface 3*a* of the top cover 3. It is desirable that the air holes 11 be spaced apart from one another so as to allow heated air supplied from the drying duct 40 to transfer uniformly to laundry disposed above the body 2. In an embodiment, the air holes 11 are arranged in a line at the upper edge part of the top cover 3. However, an embodiment is not limited thereto. For example, the air holes 11 may be formed in two lines.

The rack member 20 includes a first rack member 21 which is fixed to the body 2 and is provided to be vertically movable, and a second rack member 22 which is coupled to an upper end of the first rack member 21.

The first rack member 21 is coupled to the rear side panel 2*d* of the body 2, and an assembly groove 2*f* is formed at the rear side panel 2*d* so as to be assembled with the first rack member 21.

Accordingly, the first rack member 21 is inserted in the assembly groove 2*f* of the rear side panel 2*d*, and may be assembled by a fixing element 2*g*. In an embodiment, the first rack member 21 is fixed to the assembly groove 2*f* by the fixing element 2*g*. However, an embodiment is not limited thereto. For example, the first rack member 21 may be formed inside the rear side panel 2*d*.

The first rack member 21 may be formed in each of left and right sides of the rear side panel 2*d*, and the second rack member 22 coupled to the upper end of the first rack member 21 may be formed in a square shape.

In this case, it is desirable that a size of the second rack member 22 correspond to that of the top cover 3.

Accordingly, when using a washing machine without drying, the second rack member 22 is coupled to an upper part of the top cover 3, and when drying, the first rack member 21 is moved upward, and the second rack member 22 is positioned so as to allow the laundry to hang thereon.

The first rack member 21 includes a fixing rack 21*b* which is provided to be fixed to the rear side panel 2*d* of the body 2, a moving rack 21*a* which is provided to be movable from in and out of the fixing rack 21*b*, and a locking apparatus 30 which locks or unlock the movement of the moving rack 21*a* between the fixing rack 21*b* and the moving rack 21*a*.

The locking apparatus 30 includes a handle 31 which is disposed between a bottom surface of the second rack member 22 and the moving rack 21*a* of the first rack member 21, a first moving member 33 which is coupled to the handle 31 and vertically moves the moving rack 21*a*, a wire 34 which is coupled to the first moving member 33, a second moving member 35 which is coupled to the wire 34, an elastic member 36 which elastically supports the second moving member 35, a locking ball 37 which interlocks with the movement of the second moving member 35, and a supporting bracket 38 which supports the locking ball 37.

The handle 31 includes a bar 32 which penetrates thereinside, and the bar 32 penetrates the moving rack 21*a* and is coupled to the first moving member 33 provided therein. The first moving member 33 includes a wire connection hole 33*a* which is provided at a lower part thereof so as to be coupled to the wire 34.

The second moving member 35 includes a wire connection hole 35*c* which is provided at an upper part thereof so as to be coupled to the wire 34.

Accordingly, the wire 34 couples the first moving member 33 and the second moving member 35 by the wire connection hole 33*a* of the first moving member 33 and the wire connection hole 35*c* of the second moving member 35, and when the handle 31 is moved upward, the first moving member 33 coupled to the handle 31 and the second moving member 35 coupled to the wire 34 are moved upward.

The second moving member 35 includes a front part 35*a* and a rear part 35*b*, the front part 35*a* and the rear part 35*b* are connected by a sliding part 35*d*, and a width d1 of the front part 35*a* is formed to be smaller than a width d2 of the rear part 35*b* (d1<d2).

The supporting bracket 38 which supports the elastic member 36 and supports the locking ball 37 between the moving rack 21*a* and the fixing rack 21*b* provided at the outside of the second moving member 35.

The guide hole 38*a* for guiding the locking ball 37 is formed in the supporting bracket 38.

The locking ball 37 is movably supported between the guide hole 38*a* of the supporting bracket 38 and the second moving member 35. In this case, the locking ball 37 may be supported by being moved to the front part 35*a* and the rear part 35*b* through the sliding part 35*d* of the second moving member 35.

Locking holes 21*c* are formed in the fixing rack 21*b* such that the locking ball 37 is coupled and supported. The locking holes 21*c* of the fixing rack 21*b* may be formed at an initial position P1 in a state in which the second rack member 22 is coupled to the body 2 and is not moved, and a hanging position P2 for hanging the laundry by moving upward from the body 2. In an embodiment, the locking holes 21*c* are positioned at the initial position P1 and the hanging position P2. However, an embodiment is not limited thereto. For example, at least one of the locking holes 21*c* may be formed between the initial position P1 and the hanging position P2 in order to variably set the hanging position.

In a state in which the locking ball 37 is fixed to the locking holes 21*c* of the fixing rack 21*b*, the moving rack 21*a* is locked and is not moved (see FIG. 4).

In this case, the locking ball 37 is supported by the rear part 35*b* of the second moving member 35.

When the second moving member 35 is moved upward by the wire 34 due to the movement of the handle 31, the locking ball 37 is deviated from the locking holes 21*c* of the fixing rack 21*b*, and is moved upward according to the supporting bracket 38.

In this case, the locking ball 37 is supported by the front part 35*a* through the sliding part 35*d* of the second moving member 35 (see FIG. 5).

The moving rack 21*a* may be separated from the fixing rack 21*b* and may be movable upward.

Accordingly, the moving rack 21*a* fixed to the fixing rack 21*b* by the locking apparatus 30 can stably support the second rack member 22, and support the laundry hung on the second rack member 22.

Figure 6:
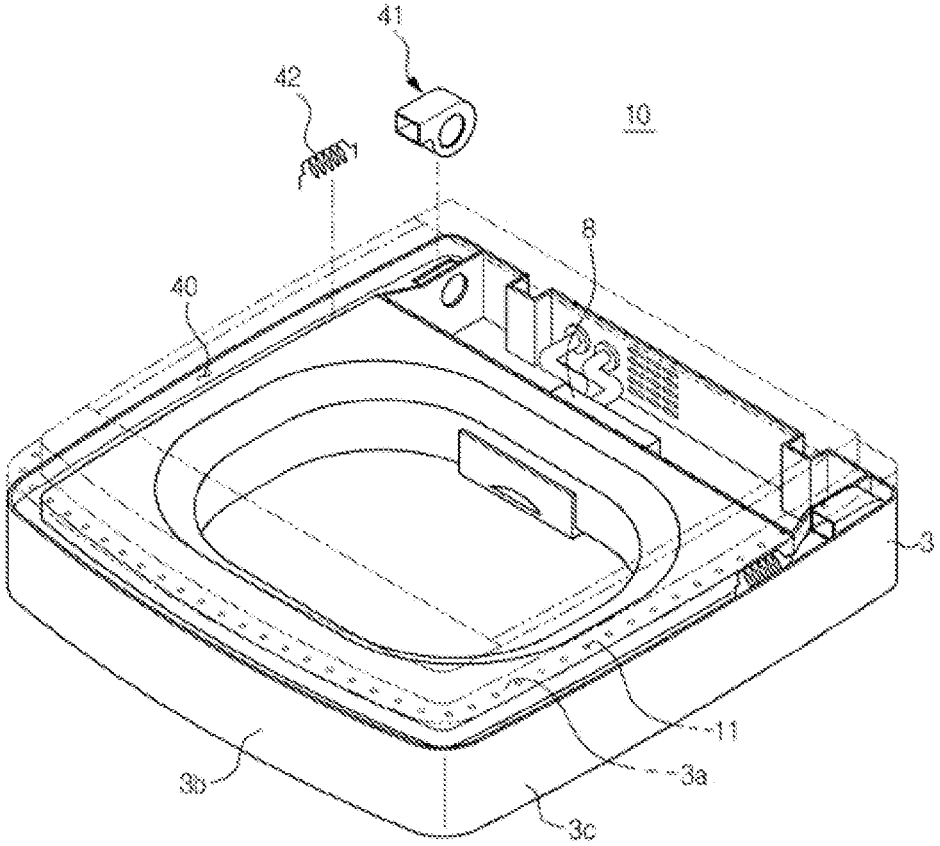
FIG. 6 is a schematic diagram of a drying duct according to an embodiment.
Figure 7:
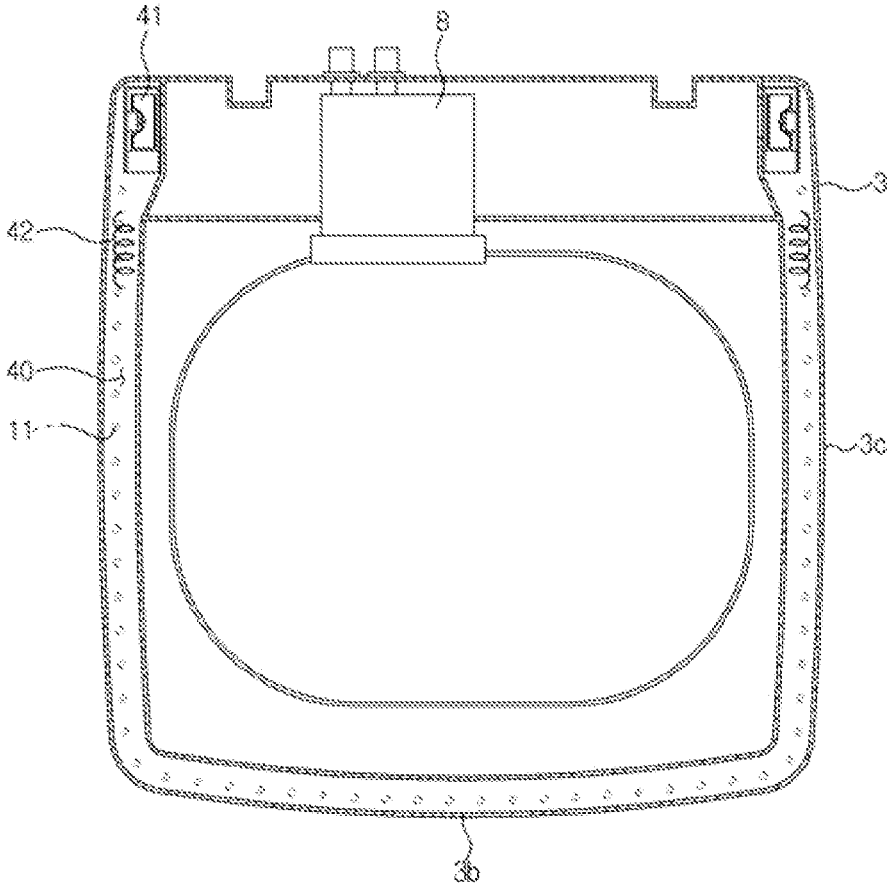
FIG. 7 is a top view of a drying duct according to an embodiment.
Figure 8:
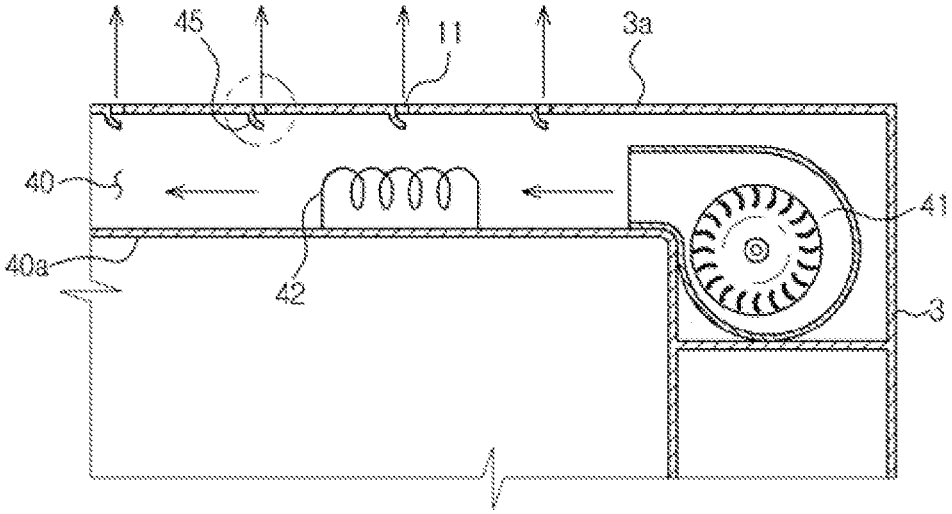
FIG. 8 is a diagram illustrating air flow of a drying duct according to an embodiment.
Figure 9:
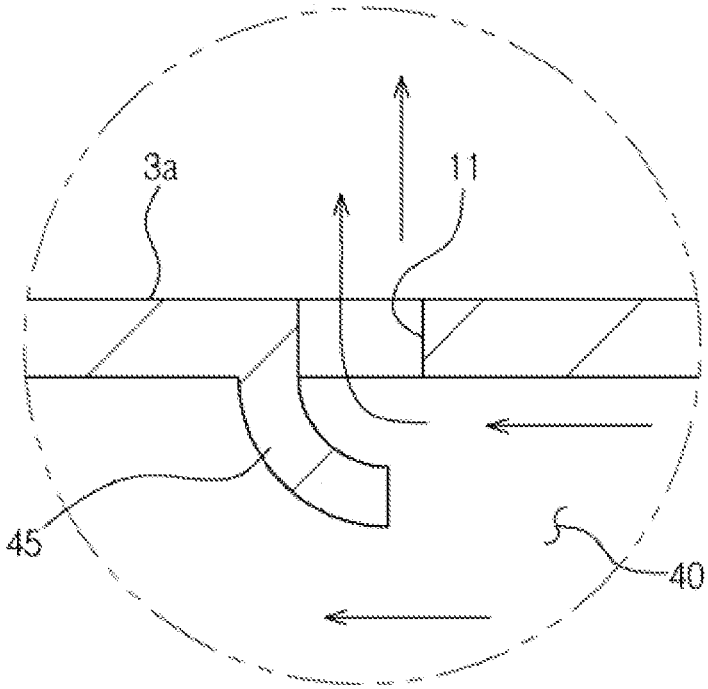
FIG. 9 is a diagram illustrating air discharge of an air hole by a guide member according to an embodiment.
Figure 10:
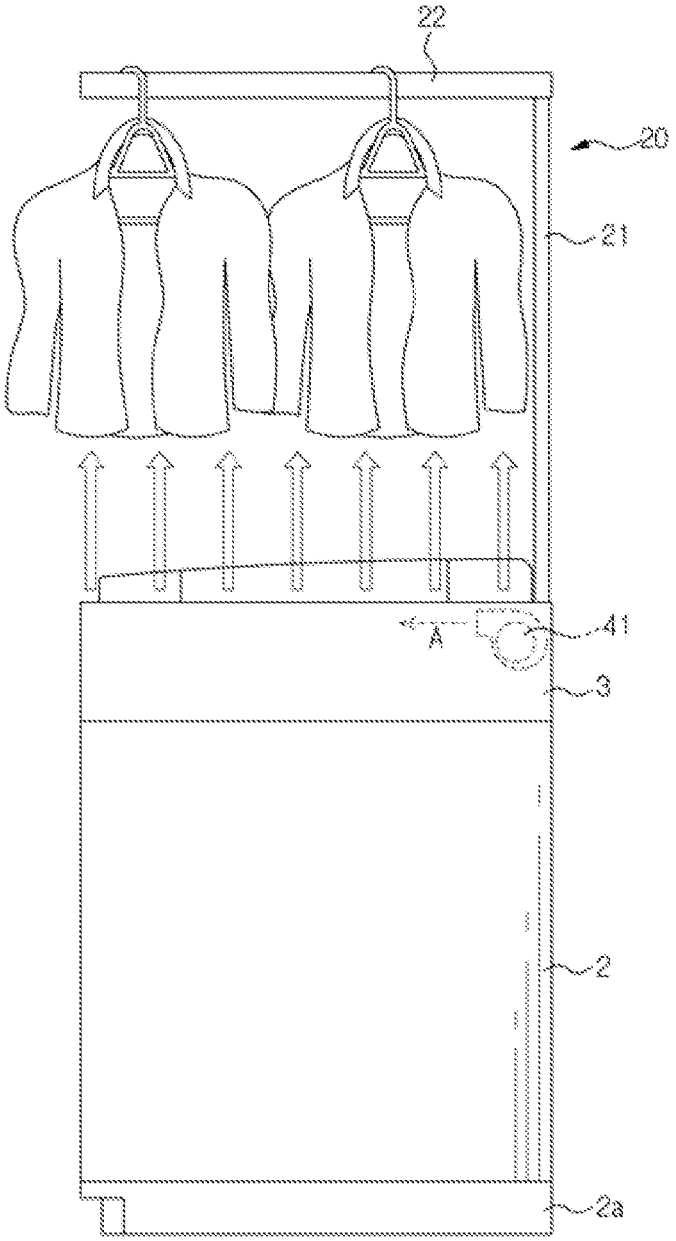
FIG. 10 is a schematic diagram for explaining a drying operation of laundry by a drying apparatus according to an embodiment.

FIG. 6 is a schematic diagram of a drying duct according to an embodiment, FIG. 7 is a top view of a drying duct according to an embodiment, FIG. 8 is a diagram illustrating air flow of a drying duct according to an embodiment, FIG. 9 is a diagram illustrating air discharge of an air hole by a guide member according to an embodiment, and FIG. 10 is a schematic diagram for explaining a drying operation of laundry by a drying apparatus according to an embodiment.

As shown in FIGS. 6 to 10, a drying duct 40 is provided inside the top cover 3.

The drying duct 40 includes a drying panel 40*a* provided to be spaced apart from an inner surface of the top cover 3 by a predetermined distance so as to heat air and supply the heated air to the air hole 11 of the top cover 3.

The drying panel 40*a* is provided to be spaced apart from the inner surfaces of the top surface 3*a*, the front surface 3*b*, and the both side surfaces 3*c* of the top cover 3 by the predetermined distance, and forms a flow path that allows the heated air to flow through an inner space formed by the drying panel 40*a*, the top surface 3*a*, the front surface 3*b*, and both side surfaces 3*c* of the top cover 3.

Air blast fans 41 are installed in both of the side end parts so as to allow the heated air to flow well inside the drying duct 40.

Further, heaters 42 are installed in front of the air blast fans 41 so as to heat the air transferred from the air blast fans 41.

Accordingly, the air transferred from the air blast fans 41 is supplied in a front side direction A of the body 2, and is heated by the heaters 42. The heated air moves upward from the body 2 through the air hole 11 formed in the drying duct 40.

The heated air that has moved upward from the body 2 is directly transferred to the laundry hung on the rack member 20 of the drying apparatus 10 positioned above the body 2 and dries the laundry (see FIG. 10).

In this case, the amount of air discharged through the air hole 11 may be increased by a guide member 45 provided in a bottom part of the air hole 11.

The guide member 45 is formed to have curvature so as to change an air flow direction in the bottom part of the air hole 11, prevents swirling around the air hole 11, increases the amount of air discharged through the air hole 1, and shortens a drying time.

Figure 11:
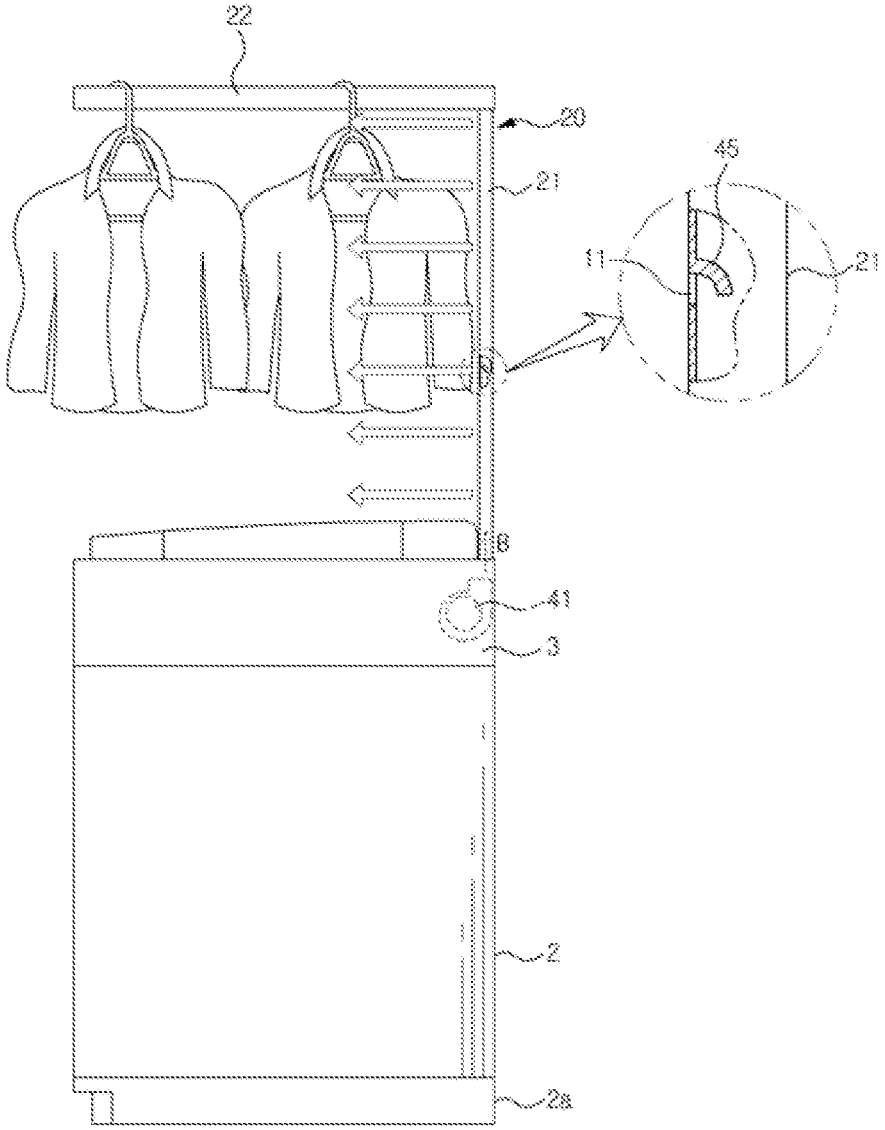
FIG. 11 is a schematic diagram for explaining a drying operation of laundry by a drying apparatus according to an embodiment.
Figure 12:
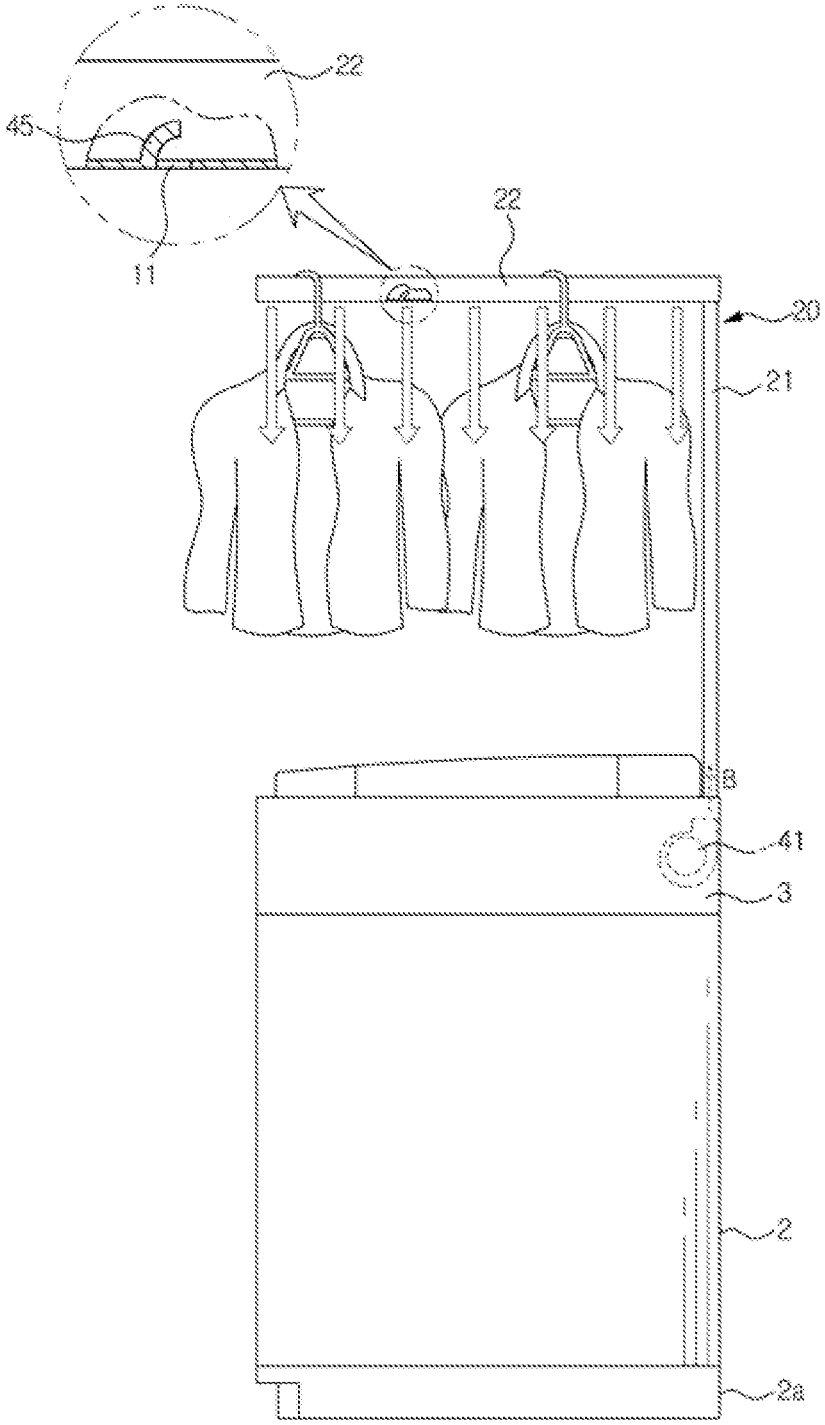
FIG. 12 is a schematic diagram for explaining a drying operation of laundry by a drying apparatus according to an embodiment.
Figure 13:
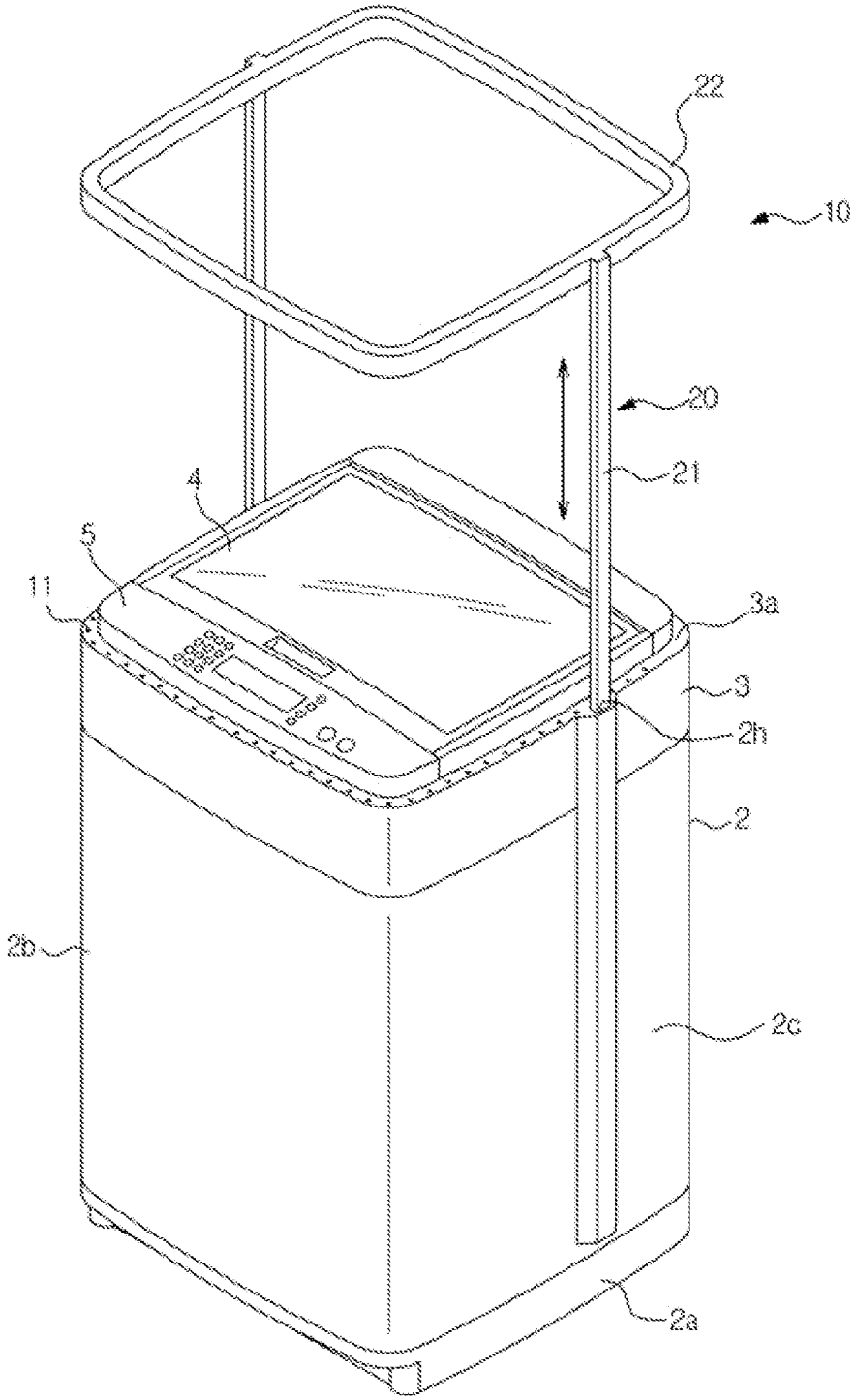
FIG. 13 is a perspective view of a washing machine having a drying apparatus according to an embodiment.

FIG. 11 is a schematic diagram for explaining a drying operation of laundry by a drying apparatus according to an embodiment, FIG. 12 is a schematic diagram for explaining a drying operation of laundry by a drying apparatus according to an embodiment, and FIG. 13 is a perspective view of a washing machine having a drying apparatus according to an embodiment.

As shown in FIGS. 11 and 12, the air hole 11 for drying the laundry may be provided in the rack member 20 of the drying apparatus 10.

In order to efficiently and quickly dry the laundry above the body 2, the air hole 11 provided for discharging the heated air is provided in the first rack member 21 of the rack member 20 of the drying apparatus 10.

Particularly, it is desirable that the air hole 11 formed in the first rack member 21 be formed to spray the air formed in and discharged from a front side of the moving rack 21*a* in the forward direction of the body 2.

In this case, the drying duct 40 is provided inside the moving rack 21*a*, and the air blast fans 41 may be disposed so as to supply the air upward from the body 2.

Further, a guide member 45 is formed inside the drying duct 40 and in the air hole 11 so as to change an air flow direction to a forward direction.

Moreover, the air hole 11 may be formed in the second rack member 22 of the rack member 20.

In this case, it is desirable that the air hole 11 be formed in a bottom side of the second rack member 22 so as to spray the discharged air downward from the body 2.

The air hole 11 can shorten a drying time of laundry, increase use of space, and improve drying efficiency by directing supplying heated air to the laundry hung above the body 2 of the washing machine in various directions.

In an embodiment, the rack member 20 in which the fixing rack 21*b* of the first rack member 21 is coupled to the assembly groove 2*f* of the rear side panel 2*d* of the body 2 is illustrated. However, embodiments not limited thereto. For example, the rack member 20 may be installed in the side panel 2*c* of the body 2.

As shown in FIG. 13, the rack member 20 provided for hanging the laundry above the body 2 includes the first rack member 21, and the second rack member 22 fixed to an upper end of the first rack member 21.

The first rack member 21 for being fixed on the body 2 includes the fixing rack 21*b* fixed on the body 2, and the moving rack 21*a* provided to be movable in and out of the fixing rack 21*b*. Since the moving structure and operation of the first rack member 21 are the same as described above, description thereof will not be repeated.

The fixing rack 21*b* is installed in a rack installing part 2*h* provided on the side panel 2*c* of the body 2, and the moving rack 21*a* coupled to the fixing rack 21*b* and the second rack member 22 coupled to an end part of the moving rack 21*a* are coupled to the top cover 3 of the body 2 due to the movement of the moving rack 21*a*.

Accordingly, the second rack member 22 is moved only when the laundry is dried, and when the washing machine 1 is not used or only the washing machine 1 is used, the second rack member 22 is not separated from the top surface 3*a* of the top cover 3. Therefore, the washing machine can increase use of space, and can preserve aesthetic appearances.

According to an embodiment, a drying operation by heated air can be performed, a drying time can be shortened by supplying the heated air in various directions, and drying efficiency can be increased.

Further, embodiments can maximize use of space by the drying apparatus which has an extractable structure in an upward direction from the washing machine.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A washing machine having a drying apparatus, comprising:

a body;

a top cover disposed on an upper part of a body;

an opening disposed at the top cover to load laundry in the body;

a plurality of air holes disposed around the opening;

an air duct disposed along the air holes to supply air to the air holes;

an air blast fan disposed at an end of the air duct; and a rack member which is configured to be extractable from the body to hang laundry above the body, the rack member comprising a first rack member coupled to the body and a second rack member coupled to the first rack member, wherein the second rack member has a portion extending along the plurality of the air holes.

2. The washing machine according to claim 1, wherein a guide member is provided in a bottom part of the air hole to guide air flow upward.

3. The washing machine according to claim 2, wherein the guide member has curvature.

4. The washing machine according to claim 1, further comprises a heater disposed in the air duct.

5. The washing machine according to claim 1, wherein the air blast fan comprises a pair of air blast fans provided in opposite sides in the air duct to blow air in a same direction.

6. The washing machine according to claim 1, wherein the rack member comprises a first rack member configured to be installed in the body and to be vertically movable in the body, and a second rack member configured to be coupled to an upper end of the first rack member and configured to hang the laundry.

7. The washing machine according to claim 6, wherein one or more air holes are formed in the first rack member.

8. The washing machine according to claim 7, wherein a guide member to guide air flow to the one or more air holes in the first rack member.

9. The washing machine according to claim 6, wherein one or more of air holes are formed in a bottom surface of the second rack member.

10. The washing machine according to claim 1, wherein the first rack member comprises a fixing rack fixed to the body, a moving rack configured to be movable from an inner side to an outer side of the fixing rack, and a locking apparatus to lock or unlock movement of the moving rack between the fixing rack and the moving rack.

11. The washing machine according to claim 10, wherein the locking apparatus comprises a handle, a first moving member provided inside the moving rack and coupled to the handle, a wire coupled to the first moving member, a second moving member coupled to the wire and configured to be vertically movable, an elastic member to elastically support the second moving member, a locking ball configured to lock or unlock the movement of the moving rack by interlocking with movement of the second moving member, and a supporting bracket to support the locking ball between the moving rack and the fixing rack.

* * * * *